US008851537B2

(12) United States Patent
Ishii

(10) Patent No.: US 8,851,537 B2
(45) Date of Patent: Oct. 7, 2014

(54) ASSISTING MECHANISM OF MOVABLE BODY

(75) Inventor: Yosuke Ishii, Frankfurt am Main (DE)

(73) Assignee: Nifco Inc., Yokohama-Shi (JP)

( * ) Notice: Subject to any disclaimer, the term of this patent is extended or adjusted under 35 U.S.C. 154(b) by 714 days.

(21) Appl. No.: 12/998,424

(22) PCT Filed: Oct. 19, 2009

(86) PCT No.: PCT/JP2009/067990
§ 371 (c)(1),
(2), (4) Date: Jun. 28, 2011

(87) PCT Pub. No.: WO2010/047299
PCT Pub. Date: Apr. 29, 2010

(65) Prior Publication Data

US 2011/0254292 A1 Oct. 20, 2011

(30) Foreign Application Priority Data

Oct. 20, 2008 (JP) ..... 2008-270331

(51) Int. Cl.

| | |
|---|---|
| ***E05B 15/02*** | (2006.01) |
| ***E05F 5/02*** | (2006.01) |
| ***E05B 17/00*** | (2006.01) |
| ***E05C 19/02*** | (2006.01) |
| *E05B 15/00* | (2006.01) |

(52) U.S. Cl.
CPC ..... *E05F 5/027* (2013.01); *E05Y 2900/132* (2013.01); *E05B 17/0025* (2013.01); *E05C 19/024* (2013.01); *Y10S 292/04* (2013.01)
USPC ..... 292/341.15; 292/1; 292/194; 292/341.17; 292/DIG. 4

(58) Field of Classification Search
USPC ..... 292/1, 194, 216, 341.15, 341.17, DIG. 4
See application file for complete search history.

(56) References Cited

U.S. PATENT DOCUMENTS

| | | | | |
|---|---|---|---|---|
| 652,828 | A * | 7/1900 | Bailey | 292/78 |
| 1,663,300 | A * | 3/1928 | Halper | 292/341.17 |
| 4,230,352 | A * | 10/1980 | Sealey et al. | 292/341.17 |
| 6,327,879 | B1 * | 12/2001 | Malsom | 70/97 |

(Continued)

FOREIGN PATENT DOCUMENTS

| | | |
|---|---|---|
| WO | WO 2007/055204 | 5/2007 |
| WO | WO 2008/069248 | 6/2008 |

OTHER PUBLICATIONS

Europe Patent Office, "European Search Report for EP 09821996.7," May 14, 2014.

*Primary Examiner* — Carlos Lugo
(74) *Attorney, Agent, or Firm* — Manabu Kanesaka

(57) ABSTRACT

A catcher is supported on a base to be capable of reciprocal movement between a standby position where a striker can be caught or released and a final position, and moves slidingly toward the final position after rotating at a fixed angle from the standby position during forward movement from the standby position. Holding of the state in which the catcher is in the standby position, and the aforementioned sliding movement, are accomplished by urging of an urging device provided on the base. The aforementioned holding is released and forward rotation of the catcher is started when the striker is caught by the catcher in the standby position by forward movement of a movable body, and this forward movement is assisted by the aforementioned urging from mid-course of this forward movement.

14 Claims, 11 Drawing Sheets

(56) References Cited

U.S. PATENT DOCUMENTS

| | | | | |
|---|---|---|---|---|
| 6,848,759 | B2 * | 2/2005 | Doornbos et al. | 312/319.1 |
| 7,201,409 | B2 * | 4/2007 | Adachi et al. | 292/304 |
| 7,743,464 | B2 * | 6/2010 | Tomioka et al. | 16/64 |
| 7,945,993 | B2 * | 5/2011 | Tomioka et al. | 16/64 |
| 8,001,654 | B2 * | 8/2011 | Tomioka et al. | 16/64 |
| 8,186,010 | B2 * | 5/2012 | Tomiji et al. | 16/64 |
| 8,376,423 | B2 * | 2/2013 | Lesjak | 292/333 |
| 2001/0008037 | A1 * | 7/2001 | Brustle | 16/71 |
| 2006/0012187 | A1 | 1/2006 | Adachi et al. | |
| 2010/0005621 | A1 * | 1/2010 | Tomioka et al. | 16/82 |

* cited by examiner

ASSISTING MECHANISM OF MOVABLE BODY

TECHNOLOGICAL FIELD

This invention relates to a mechanism that is activated when a movable body, being combined on a main body to be capable of deployment from a reference position and to be capable of reciprocal movement, is operated to move forward from the deployment position up to a prescribed position toward the reference position, to thereby assist the forward movement of the movable body to the reference position.

BACKGROUND TECHNOLOGY

There is a withdrawing mechanism, provided with a catcher on a door frame, for catching a striker, provided on a door, in a prescribed position when the door is operated to rotate toward a closed position. Such catcher is provided so as to rotate reciprocally between a standby position and a withdrawn position, and is forcibly rotated by force of a spring from the prescribed position of rotation up to the withdrawn position, thereby to assist the forward movement of the door toward the closed position. (See patent document 1)

Here, in such withdrawing mechanism, the forward movement of the door can be assisted over a wider range as the amount of rotation of the catcher is increased. However, for example, in the case when an apparatus main body supporting the catcher is provided on the door frame of such door, there is a requirement to make the width of the apparatus main body as small as possible because there is a limitation as to the width of the door frame in the direction of forward movement, that is, the front-to-back direction, of the door, and accordingly there is a limitation as to how much the amount of rotation of the catcher can be increased to assist the forward movement of the door over a wider range.

Also, in such withdrawing mechanism, damping force is applied through the catcher to the forward movement of the door by plunging of a piston rod of a piston damper in linkage with the rotation of the catcher. However, it is difficult to ensure a great amount of plunging by only having the piston rod plunged by the rotation of the catcher, and therefore it may be difficult to apply a sufficient damping force to the forward movement of the door.

PRIOR ART DOCUMENTS

Patent Documents

International Publication No. 2007/055204

SUMMARY OF THE INVENTION

Problems to be Solved by the Invention

The main problem to be solved by this invention is to make the width of an assisting mechanism for door or other movable body as small as possible. More specifically, it is to make the width of an assisting mechanism for door or other movable body as small as possible, without reducing the range (stroke) for assisting the forward movement of the movable body from a prescribed position.

Means for Solving the Problems

In order to solve the aforementioned problem, the assisting mechanism for movable body in this invention is an assisting mechanism for movable body, comprising a striker, provided on either one of a main body or a movable body combined on the main body to be capable of reciprocal movement between a reference position and a deployment position, and a catcher, provided on the other of these, for catching the striker in a prescribed position when the movable body is operated to move forward toward the reference position, and for assisting the forward movement of the movable body to the reference position, wherein:

the catcher is supported on a base to be capable of reciprocal movement between a standby position where the striker can be caught or released and a final position, and moves sliding toward the final position after rotating at a fixed angle from the standby position during forward movement from the standby position; and at least holding of the state in which the catcher is in the standby position, and the aforementioned sliding movement, are accomplished by urging of urging means provided on the base; the aforementioned holding is released and forward rotation of the catcher is started when the striker is caught by the catcher in the standby position by forward movement of the movable body, and the forward movement is assisted by the aforementioned urging from mid-course of the forward movement.

Preferably, the base has a width and a length, and the sliding movement of the catcher is performed following the length direction.

By such constitution, the striker can be caught in the prescribed position by the catcher when the movable body is operated to move forward toward the reference position, and the forward movement of the movable body toward the reference position can be assisted by the catcher. Because such forward movement of the catcher becomes sliding movement from mid-course, the space for the forward movement of the catcher can be made smaller compared to the case when such forward movement of the catcher is entirely dependent on rotation, and the width of the assisting mechanism in the direction orthogonal to the direction of the aforementioned sliding movement of the catcher can be made as small as possible.

Also, preferably, catching of the striker is accomplished by a receiving groove for the striker formed on the aforementioned catcher;

the receiving groove has an introducing part and a withdrawing part, the catcher is rotated by the striker on entering the introducing part in the standby position, and the striker is guided to the withdrawing part by the rotation; and the withdrawing part is formed so as to intersect with the direction of sliding movement of the catcher.

By doing such, the striker is guided to the withdrawing part by the introducing part of the receiving part when the forward rotation of the catcher starts, and is next withdrawn into the base by the sliding movement toward the final position of the catcher after reaching the withdrawing part.

The movement of the aforementioned catcher can be ensured by: providing cam means for cooperatively controlling the reciprocal movement of the catcher respectively on the catcher and the base;

providing a shaft body on either one of the catcher or the base in a position to serve as a center of rotation during rotation of the catcher; and providing a shaft bearing part on the other of these to axially support the shaft body in a manner so as to release the axial support of the shaft body during sliding movement of the catcher.

Or, the movement of the aforementioned catcher can be assured by: providing first cam means for cooperatively controlling the reciprocal movement of the catcher respectively on the catcher and the base;

providing second cam means for cooperatively controlling the reciprocal movement of the catcher respectively on the catcher and the base in different positions from the first cam means;

constituting both cam means with a cam groove and a sliding element to be guided therein; and providing the cam grooves of both cam means respectively with a first part following an arc of a virtual circle centered on the center of rotation during rotation of the catcher, and a second part continuing therefrom and extending in a straight line.

If the aforementioned assisting mechanism is provided with damping means for applying a damping force to the forward movement of the catcher, then the damping force can be applied further ahead from the prescribed position through the catcher to the forward movement of the movable body toward the reference position, and this forward movement can be accomplished gently.

In this case, the damping means may be made as a piston damper using resistance to movement of a piston inside a cylinder as damping force; and either one of a piston rod or the cylinder may be fixed to the base, and the other of these may be connected to the catcher so that movement or relative movement of the piston is brought about by forward movement of the catcher.

Also, in this case, the piston damper and the catcher may further be connected by a connecting member combined on the base to be capable of sliding movement following the direction of sliding movement of the catcher; and either one of a connecting cam groove formed in a direction diagonally intersecting the direction of sliding movement or a connecting sliding element to be guided therein may be formed on the catcher, and the other of these may be formed on the connecting member.

By doing such, the damping force of the aforementioned piston damper can be applied in the entire process of the forward movement when the catcher is moved forward. Also, because the forward movement of the catcher becomes the aforementioned sliding movement from mid-course, a greater amount of plunging of the piston rod constituting the piston damper into the cylinder than in the case when the piston rod is plunged using only rotation of the catcher is easily ensured, and a sufficient damping force can be applied through the catcher to the forward movement of the movable body from the prescribed position.

Also, the aforementioned urging means may be provided with a contacting part corresponding to a contacted part of the catcher, and either one of the contacted part or the contacting part or both may be constituted as a protruding form, so that the contacted part rides over the contacting part while pushing the side of the contacting part inward in a direction opposing the urging in the process of forward movement of the catcher in the standby position.

By doing such, the state in which the catcher is in the standby position can be held by the urging of the urging means, and the forward movement of the catcher can be assisted by the urging of the urging means after the contacted part rides over the contacting part as previously mentioned.

Also, preferably, the aforementioned base has a width and a length, the damping means are arranged between the catcher and one end of the base, and the urging means are arranged between the catcher and the other end of the base. By doing such, an increase of the width of the assisting mechanism can be prevented.

Effects of the Invention

The assisting mechanism according to this invention can be constituted having a width as small as possible. Also, in the assisting mechanism according to this invention, the width can be made as small as possible without reducing the range (stroke) for assisting the forward movement of the movable body from a prescribed position. That is, because the forward movement of the catcher constituting such assisting mechanism after catching the striker becomes sliding movement from mid-course, the space for the forward movement of the catcher can be made smaller compared to the case when such forward movement of the catcher is entirely dependent on rotation, and the width of the assisting mechanism in the direction orthogonal to the direction of such sliding movement can be made as small as possible.

EMBODIMENT OF THE INVENTION

A typical mode of the embodiment of this invention is described below based on FIG. 1 to FIG. 11.

Figure 1:
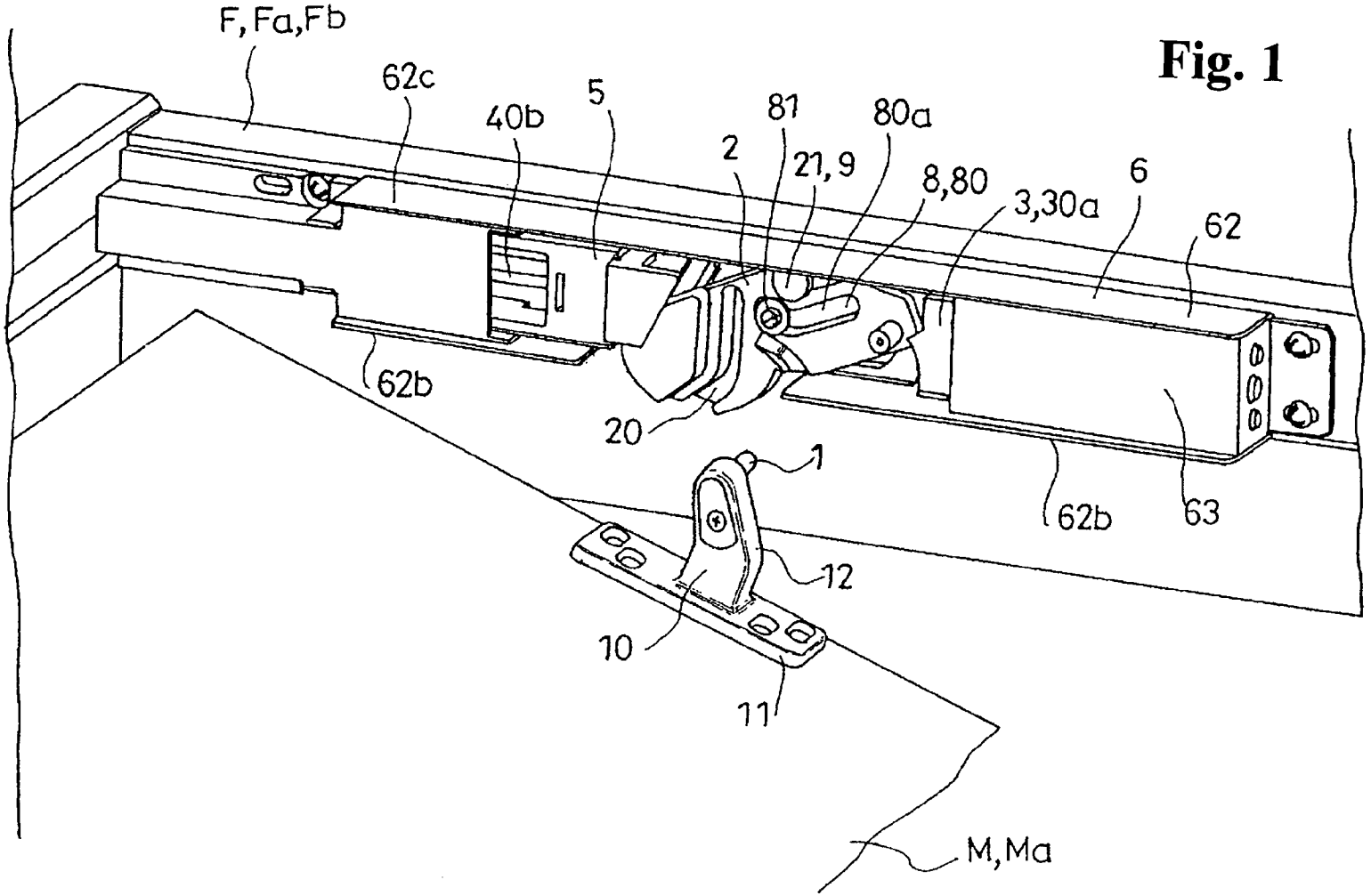
FIG. 1 is a structural diagram in perspective view seen from below of an assisting mechanism according to one mode of the embodiment of the present invention (catcher in standby position)

Here, FIG. 1 illustrates an example in which a catcher 2 constituting an assisting mechanism according to the mode of the embodiment is provided on a door frame Fa as a main body F, and a striker 1 is provided on a door Ma as a movable body M, in the condition seen from below. Also, FIG. 2 illustrates the condition of FIG. 1 seen from above.

Figure 2:
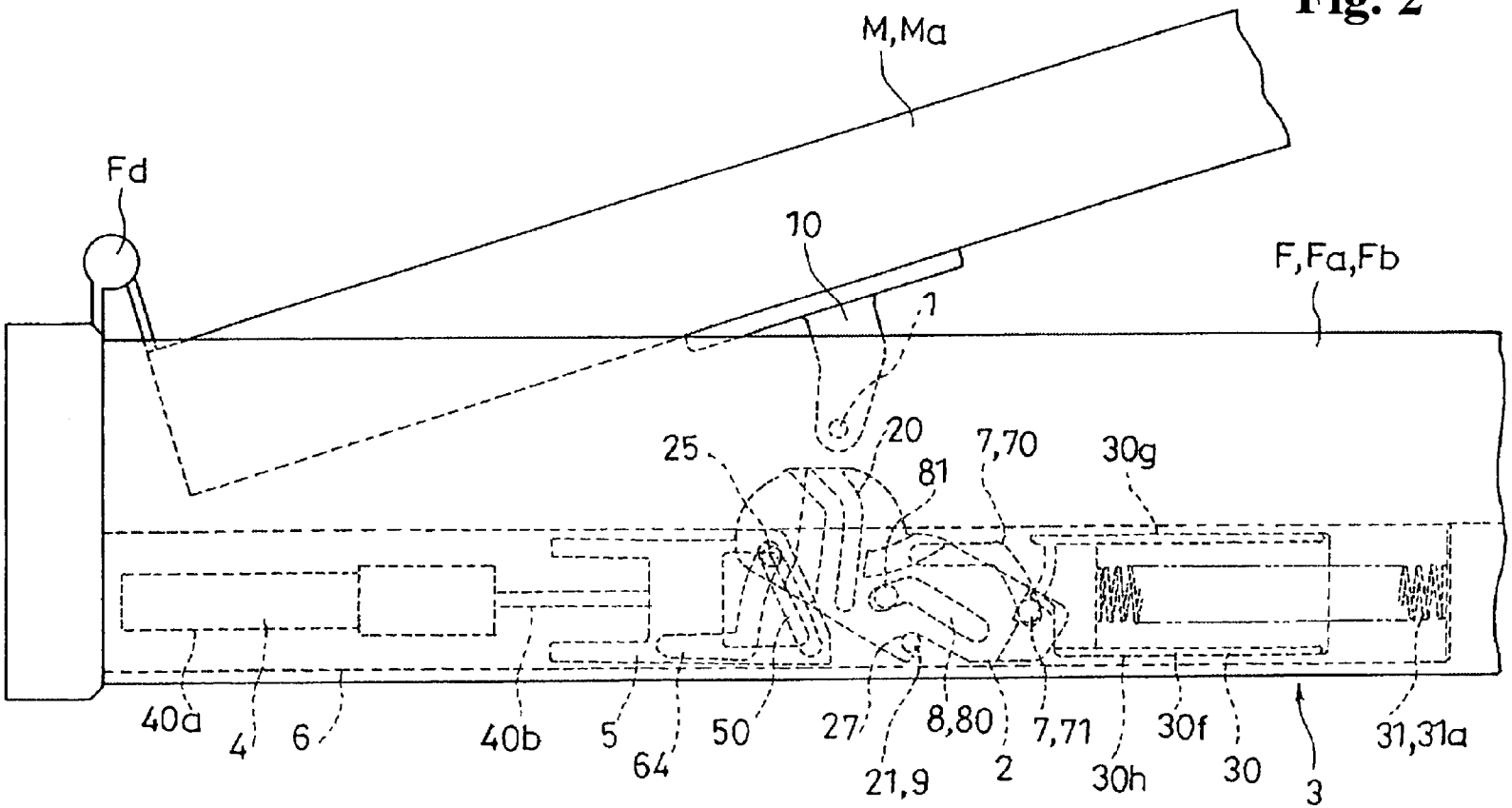
FIG. 2 is a structural diagram in plan view of the same (catcher in standby position)
Figure 8:
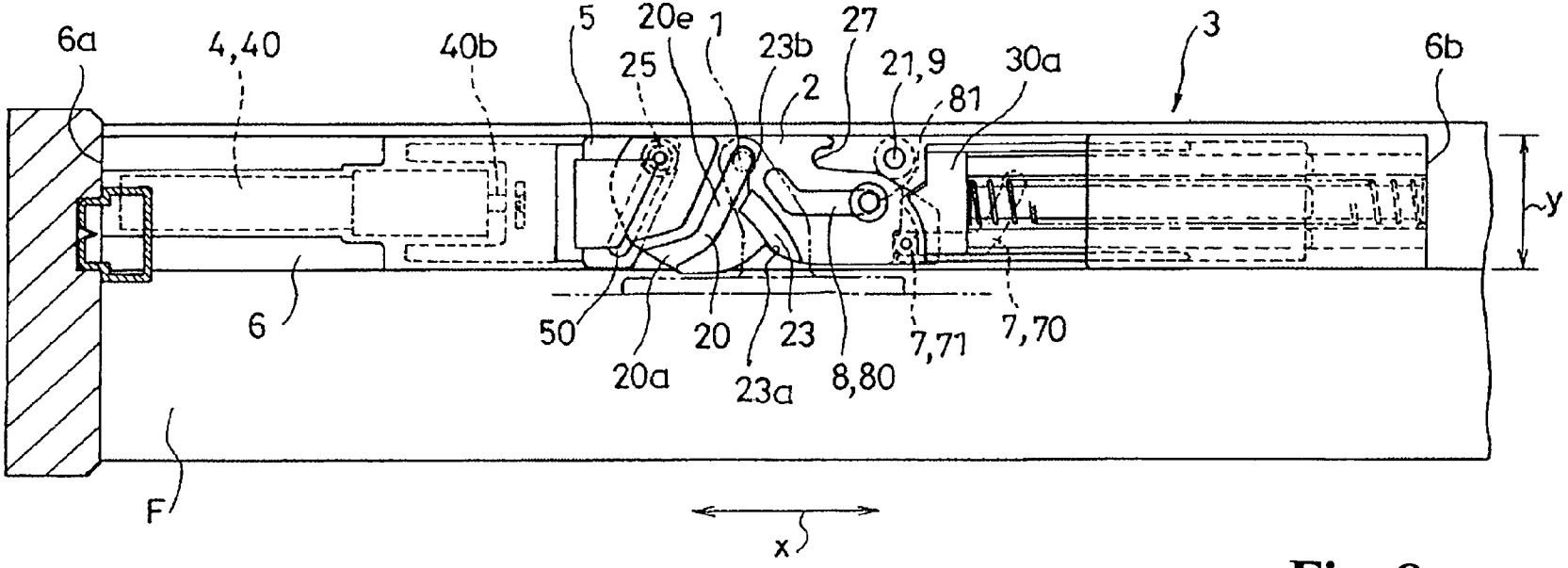
FIG. 8 is a structural diagram in bottom view of the same (catcher in final position, rotating body (door) in reference position (closed position))

FIG. 3 to FIG. 8 respectively illustrate the aforementioned assisting mechanism seen from below, FIG. 2 illustrates the condition when the catcher 2 is in a standby position, and FIG. 8 illustrates the condition when the catcher 2 is in a final position. When closing the door Ma, that is, when rotating the movable body M toward a reference position, the striker 1 strikes the catcher 2 in the standby position (FIG. 4), and the catcher 2, while catching same, is moved forward up to the final position in the sequence in FIG. 5, FIG. 6, and FIG. 7, and the movable body M is withdrawn to the reference position by means of the striker 1 body (FIG. 8).

Figure 9:
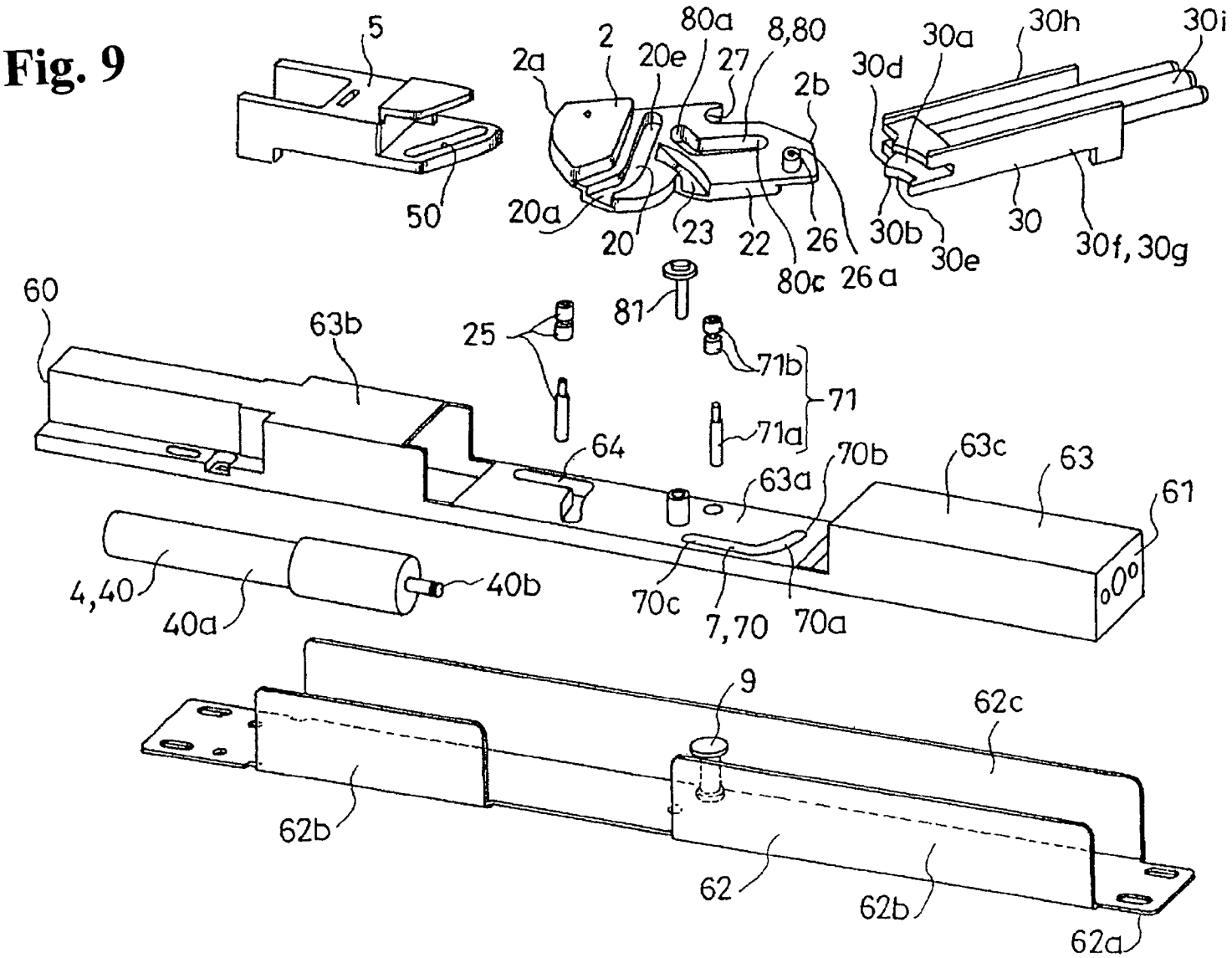
FIG. 9 is an exploded structural diagram in perspective view of the constituent members on the side of the catcher according to one mode of the embodiment of the present invention.
Figure 10:
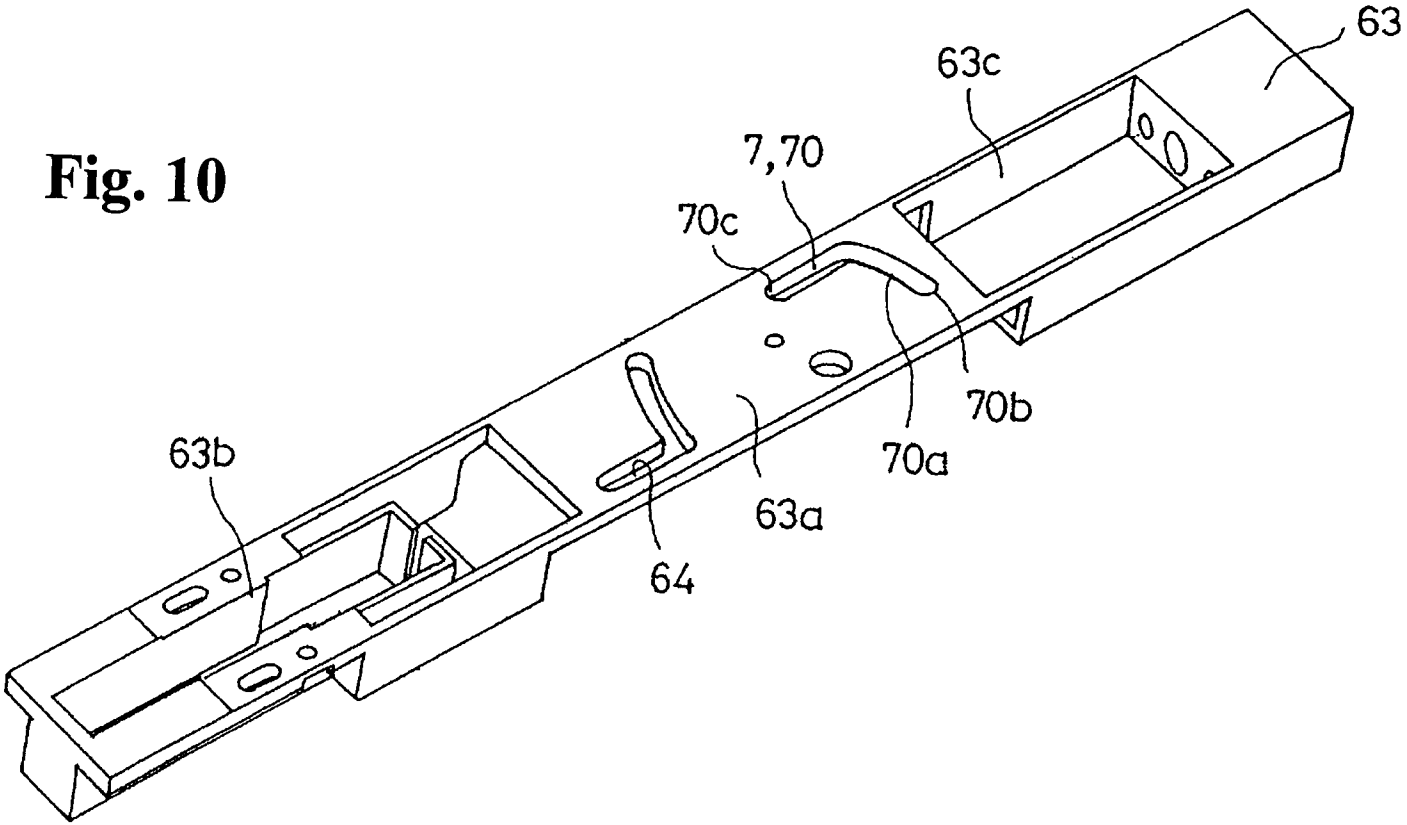
FIG. 10 is a structural diagram in perspective view of the base lower part according to one mode of the embodiment of the present invention.
Figure 11:
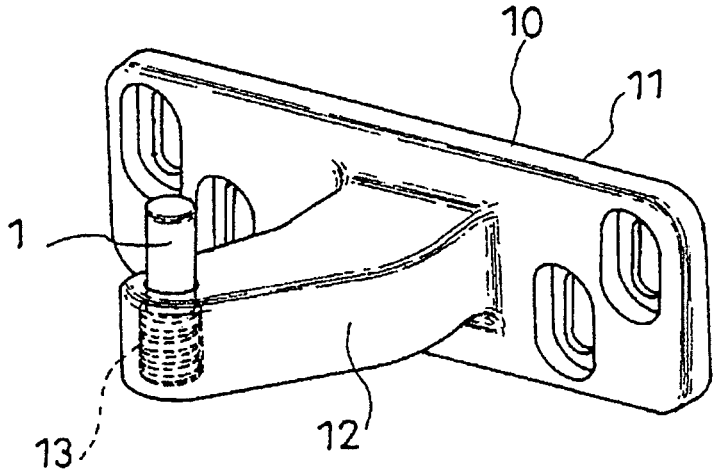
FIG. 11 is a structural drawing in perspective view of the striker side according to one mode of the embodiment of the present invention.

FIG. 9 illustrates the constituent elements on the side of the catcher 2 of such assisting mechanism in an exploded condition, and FIG. 10 illustrates a base lower part 63 among these viewed from the opposite side of FIG. 9. Also, FIG. 11 illustrates the side of the striker 1 constituting such assisting mechanism.

The assisting mechanism according to this mode of the embodiment is activated when a movable body M, being combined on a main body F to be capable of deployment from a reference position and to be capable of reciprocal movement, is operated to move forward from the deployment position up to a prescribed position toward the reference position, and functions to assist the forward movement of the movable body M up to the reference position.

Such assisting mechanism typically can be used for assisting the aforementioned forward movement of various kinds of movable bodies M, including doors of houses, doors of automobiles, and doors or lids of various kinds of equipment or instruments. Specifically, such assisting mechanism is activated when such door, or the like, is rotated forward from the deployment position, typically an open position, up to a prescribed position toward the reference position, typically a closed position, and functions to withdraw such door, or the like, to the reference position.

Such assisting mechanism comprises:

(1) striker 1;

(2) catcher 2;

(3) urging means 3;

(4) damping means 4; and (5) connecting member 5.

The striker 1 is provided on either one of the movable body M or the main body F on which the movable body M is combined to be capable of reciprocal movement.

In the illustrated example, the striker 1 is provided on the door Ma as the movable body M. Also, a striker base 10 is constituted by a mounting plate 11, and an arm 12 projecting forward from one face of the mounting plate 11, and such striker 1 is constituted so as to project upward in a shaft form from the projecting end of the arm 12 (FIG. 1, FIG. 11). The striker base 10 is provided by means of the mounting plate 11 on the upper part of the surface of the door Ma on the side that strikes a doorstop Fc. When the door Ma is positioned in the reference position, that is, the closed position, the arm 12 is positioned below a base 6 for supporting the catcher 2, to be described, so that the striker 1 projecting from the arm 12 enters into such base 6.

The catcher 2 is provided on the other of the movable body M and the main body F, and is constituted so as to catch the striker 1 moved or relatively moved closer from the front when the movable body M is operated to rotate from the deployment position toward the reference position. Such catcher 2 is supported on a base 6 to be capable of reciprocal movement between the standby position (the position in FIG. 1 to FIG. 3) where the striker 1 can be caught or released and the final position (the position in FIG. 8), and moves sliding toward the final position after rotating at a fixed angle from the standby position during forward movement from the standby position. Also, during return movement from the final position, such catcher 2 is moved sliding from the final position in the opposite direction with respect to forward movement, and is then rotated up to the standby position at a fixed angle in the opposite direction with respect to forward movement.

In this mode of the embodiment, the catcher 2 is supported to be capable of rotation on the base 6. The aforementioned urging means 3 for such catcher 2, the aforementioned damping means 4 for applying damping force to the forward movement of such catcher 2, and the aforementioned connecting member 5 between such catcher 2 and damping means 4 are arranged on the base 6. In the illustrated example, the catcher 2 is provided by means of the base 6 on the door frame Fa as the main body F corresponding to the door Ma as the movable body M (FIG. 1).

In this mode of the embodiment, such base 6 has a width and a length. Also, the damping means 4 are arranged between the catcher 2 and one end 6*a* of the base 6, and the urging means 3 are arranged between the catcher 2 and the other end 6*b* of the base 6. Also, the sliding movement of the aforementioned catcher 2 is performed following the length direction of the base 6. Also, in the illustrated example, the base 6 is provided on the side of the door frame Fa where a hinge Fd is provided, so that its length direction follows the length direction of an upper frame part Fb of the door frame Fa. Also, as described later, when the door Ma as the movable body M is operated to move forward toward the closed position, the striker 1 is caught in the prescribed position by the catcher 2 in the standby position, so that the door Ma is withdrawn to the closed position (the position in FIG. 8) by means of the striker 1 by the aforementioned forward movement of the catcher 2 after being caught.

Because such forward movement of the catcher 2 becomes sliding movement from mid-course, the space for the forward movement of the catcher 2 inside the base 6 can be made smaller compared to the case when such forward movement of the catcher 2 is entirely dependent on rotation, and the width of the base 6, that is, the width y of the assisting mechanism can be made as small as possible. Also, because the catcher 2 is arranged between the aforementioned urging means 3 and damping means 4, an increase of the width y of the assisting mechanism can be prevented. By this, the assisting mechanism according to this mode of the embodiment can be provided favorably on the upper frame part Fb of the door frame Fa, with its length direction following the length direction of the upper frame part Fb, as a mechanism for assisting the forward movement of the door Ma to the closed position.

In the illustrated example, such base 6 is made by combining a base upper part 62 and a base lower part 63. The base upper part 62 assumes a long and slender plate form. Also, its upper face is used as a mounting face 62*a* for mounting on the upper frame part Fb of the door frame Fa, and a front plate 62*b* and a rear plate 62*c* are provided respectively on a front side part following its length direction (a side part on the side near the door Ma in the closed position) and on a rear side part positioned to the rear of the front side part, respectively projecting downward from these side parts. The front plate 62*b* on such base upper part 62 is not provided in a position about halfway in the length direction of the base upper part 62, and when the door Ma is operated to rotate toward the reference position, that is, the closed position, the striker 1 provided on the door Ma, moving closer from the front, is caught by the catcher 2 supported on the base 6, through the place where this front plate 62*b* is not provided (FIG. 1). The base lower part 63 is constituted so as to have a length and a width about equal to those of the base upper part 62. A center part of the base lower part 63 is used as a support part 63*a* for the catcher 2, one of the sides holding the center part in between is used as a housing part 63*b* for the damping means 4, and the other of the sides holding the center part in between is used as a housing part 63*c* for the urging means 3. The housing part 63*c* for the urging means 3 is constituted as a box form having an opened upper face, and the side facing the support part 63*a* for the catcher 2 is opened. Also, the housing part 63*b* for the damping means 4 also is constituted as a box form having an opened upper face, and the side facing the support part 63*a* for the catcher 2 is opened. The support part 63*a* for the catcher 2 assumes a plate form attached on the lower face of the base upper part 62, a cam groove 70 of first cam means 7 to be described is formed thereon, and a sliding element 81 of second cam means 8 is provided.

The catcher 2 is provided to be capable of reciprocal movement between the standby position and the final position on such base 6. In this mode of the embodiment, the aforementioned reciprocal movement of such catcher 2 is regularly damped by the first cam means 7, the second cam means 8, and a shaft body 9, to be described. Such damping is also possible by one of these cam means 7 or 8 and such shaft body 9, and is also possible by only these cam means 7 and 8.

The catcher 2 is constituted as a board form, having a length and a width and having the board surface arranged facing sideways. Also, the catcher 2 is supported on the aforementioned support part 63*a* so that one end side 2*a* (the left side in FIG. 3) is positioned toward the side of the damping means 4, and the other end side 2*b* (the right side in FIG. 3) is positioned toward the side of the urging means 3. Also, in the standby position, the one end side 2*a* of such catcher 2 is positioned further forward than the other end side 2*b*, and the one end side 2*a* is projected forward from the base 6.

Also, the state in which such catcher 2 is in the aforementioned standby position is held by the urging of the aforementioned urging means 3. Also, when the striker 1 is caught by the catcher 2 in this standby position, the aforementioned holding is released by the forward movement of the door Ma as the movable body M, and the catcher 2 is rotated forward in the clockwise direction in FIG. 3 in opposition to the urging of the aforementioned urging means 3. The forward rotation of the catcher 2 is forcibly performed from mid-course by the urging of the urging means 3. Also, when the catcher 2 is rotated forward at a fixed angle, the shaft body 9 is released as is to be described, and the catcher 2 moves sliding toward the left side in FIG. 7 by the urging of the urging means 3, and reaches the final position.

By this, in this mode of the embodiment, the striker 1 can be caught in the prescribed position by the catcher 2 when the movable body M is operated to move forward toward the reference position, and the forward movement of the movable body M toward the reference position can be assisted by means of the catcher 2. Because such forward movement of the catcher 2 becomes sliding movement from mid-course, the space for the forward movement of the catcher 2 can be made smaller compared to the case when such forward movement of the catcher 2 is entirely dependent on rotation, and the width y of the assisting mechanism in the direction orthogonal to the direction x of the aforementioned sliding movement of the catcher 2 can be made as small as possible.

In this mode of the embodiment, catching of the striker 1 is accomplished by a receiving groove 20 for the striker 1 formed on the aforementioned catcher 2. Also, the receiving groove 20 has an introducing part 20*a* and a withdrawing part 20*e*, the catcher 2 is rotated by the striker 1 on entering the introducing part 20*a* in the standby position, the striker 1 is guided to the withdrawing part 20*e* by this rotation, and the withdrawing part 20*e* is formed so as to intersect with the direction x of sliding movement of the catcher 2.

In the illustrated example, such receiving groove 20 is formed between the center 21 of rotation of the aforementioned rotation of the catcher 2 and the one end side 2*a* of the catcher 2. Such receiving groove 20 assumes a groove form provided engraved in the lower part of the catcher 2, and a front end 20*b* of the introducing part 20*a* is opened outward on a front edge 22 of the catcher 2 oriented toward the side of the door Ma as the movable body M. Also, when the catcher 2 is in the standby position, the front end 20*b* opened on the introducing part 20*a* is positioned on the track of movement of the striker 1 provided on the door Ma as the movable body M. In the standby position of the catcher 2, the introducing part 20*a* extends diagonally so as to gradually approach the other end side 2*b* of the catcher 2 while going toward a rear end 20*c* that continues to the withdrawing part 20*e* from the front end 20*b* side. Also, in the aforementioned prescribed position, the striker 1 is struck against a groove wall 20*d* of the introducing part 20*a* positioned on the one end side 2*a* of the catcher 2, and forward rotation of the catcher 2 is started by this striking. Meanwhile, in the standby position of the catcher 2, the withdrawing part 20*e* is formed so as to extend toward the rear from the rear end 20*c* of the introducing part 20*a*, and after the end of forward rotation of the catcher 2, and extends diagonally so as to gradually approach the other end side 2*b* of the catcher 2 while going toward a rear end 20*g* from a front end 20*f* that continues on the rear end 20*c* of the introducing part 20*a* (FIG. 8). By this, in the illustrated example, when the forward rotation of the catcher 2 is started, the striker 1 is guided to the withdrawing part 20*e* by the introducing part 20*a* of the receiving groove 20 (FIG. 7), and is next withdrawn into the base 6 by sliding movement of the catcher 2 toward the final position (FIG. 8) after reaching the withdrawing part 20*e*.

Meanwhile, when the door Ma as the movable body M is operated to move in return, that is, to open, from the state in which the catcher 2 having caught the striker 1 is in the final position, the withdrawing part 20*e* of the receiving groove 20 extends diagonally so as to gradually approach the one end side 2*a* of the catcher 2 while going toward the front end 20*f*, and therefore the catcher 2 is concomitantly moved sliding (moved in return) in the opposite direction to that during forward movement. When the striker 1 enters into the introducing part 20*a*, the catcher 2 is rotated (moved in return) from there in the opposite direction to that during forward movement until it is again positioned in the standby position, and the striker 1 is released so that the return movement of the door Ma as the movable body M is allowed. The receiving groove 20 of the catcher 2 described above is constituted as a groove having a bottom in the illustrated example, but can also be constituted as a split-open groove.

Also, in this mode of the embodiment, an auxiliary groove 23 is provided to be engraved on the lower part of the catcher 2, while being formed so as to roughly follow the track of movement of the striker 1 when the catcher 2 is in the final position. This auxiliary groove 23 is formed between the receiving groove 20 and the other end side 2*b* of the catcher 2 (FIG. 8). Also, a front end 23*a* is opened outward on the front edge 22 of the catcher 2, and a rear end 23*b* is positioned forward of the withdrawing part 20*e* of the receiving groove 20. Also, in this mode of the embodiment, the striker 1 is projected upward from the striker base 10 by urging of urging means 13 provided inside the striker base 10 (FIG. 11), and is constituted so as to be capable of withdrawing in opposition to this urging. By this, in this mode of the embodiment, in the case when the catcher 2 is accidentally moved forward to the final position despite that the door Ma as the movable body M is not in the reference position, that is, the closed position, the striker 1 can be let into such auxiliary groove 23 when the door Ma is operated to move toward the closed position, and the striker 1 can furthermore ride over between the rear end

23*b* of the auxiliary groove 23 and the withdrawing part 20*e* of the receiving groove 20 by the aforementioned withdrawing of such striker 1 into the striker base 10, so that the striker 1 can be let into the withdrawing part 20*e*.

The urging means 3 are constituted by a slider 30 housed inside the housing part 63*c* of the aforementioned base 6 to be capable of sliding movement along the length direction of the base 6, and an impeller body 31 for regularly urging the slider 30 toward the side of the catcher 2.

In the illustrated example, the slider 30 has a head part 30*a* and a guide part 30*f*. The guide part 30*f* has a front part 30*g* for sliding against a front wall of the housing part 63*c* from the inside, and a rear part 30*h* for sliding against a rear wall of the housing part 63*c* from the inside. The head part 30*a* is provided between the front part 30*g* and the rear part 30*h* on one end side of such guide part 30*f*. The one end side of the guide part 30*f* is positioned further toward the side of the catcher 2 from the open place of the housing part 63*c*, whereby the head part 30*a* is positioned beneath the support part 63*a* of the catcher 2. A contacting part 30*b* is formed on the side of the head part 30*a* oriented toward the side of the catcher 2, for acting on a sliding element 71 (provided on the catcher 2) of the first cam means 7 to be described, in a different position from the cam groove 70 of the first cam means 7, with the sliding element 71 as a contacted part 24. This contacting part 30*b* is constituted as a peak form (protruding form) protruding toward the side of the catcher 2 with a tip part 30*c* positioned in a position about halfway in the front-to-back direction of the head part 30*a*, and is provided with a backward-slanted part 30*d* oriented backward and a forward-slanted part 30*e* oriented forward holding the tip part 30*c* in between. The side of the head part 30*a* on the side opposite the side of formation of the contacting part 30*b* is integrally connected to one end part of a rod body 30*i* that extends following the length direction of the base 6. Also, in the illustrated example, the impeller body 31 is constituted as a compression coil spring 31*a* coiled around the rod body 30*i*, with one spring end butted against the head part 30*a*, and the other spring end butted against a closed part 61 on the other end 6*b* of the base 6 opposite the open place of the housing part 63*c*.

Also, in this mode of the embodiment, the contacted part 24 rides over the contacting part 30*b* while pushing the side of the contacting part 30*b* inward in the direction opposing the urging in the process of forward movement of the catcher 2 in the standby position. By this, in this mode of the embodiment, the state in which the catcher 2 is in the standby position can be held by the urging of the urging means 3, and the forward movement of the catcher 2 can be assisted by the urging of the urging means 3 after the contacted part 24 rides over the contacting part 30*b* as previously mentioned.

Figure 4:
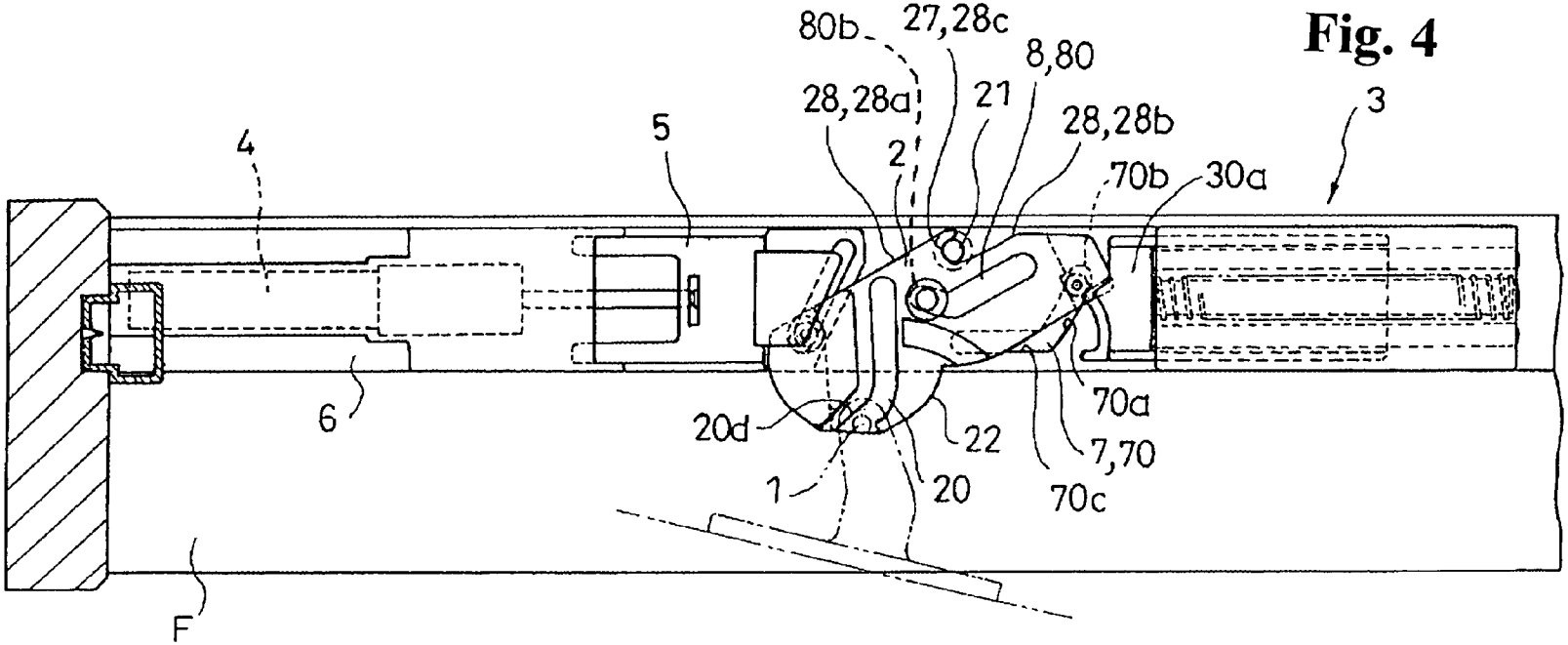
FIG. 4 is a structural diagram in bottom view of the same.
Figure 5:
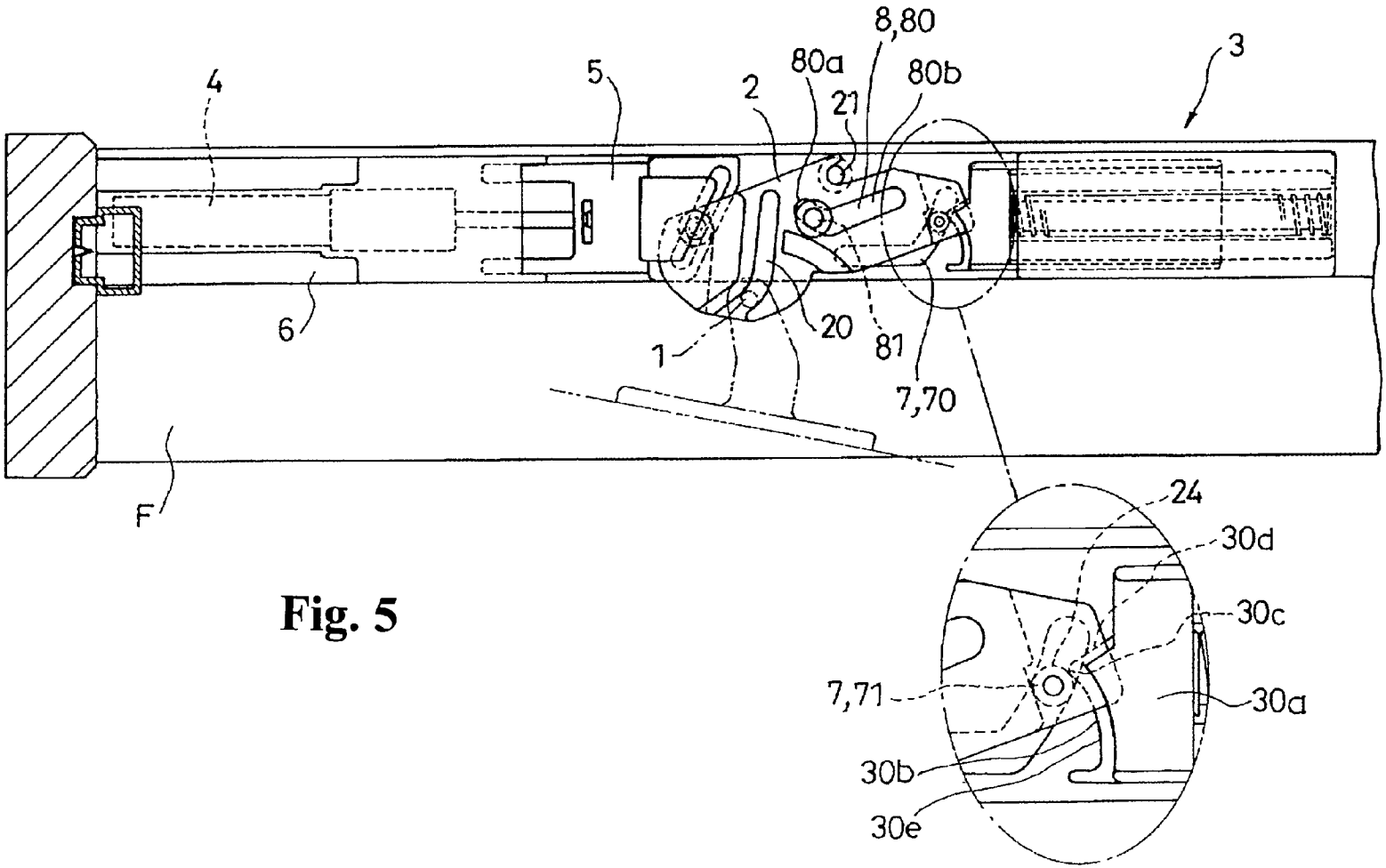
FIG. 5 is a structural diagram in bottom view of the same.
Figure 6:
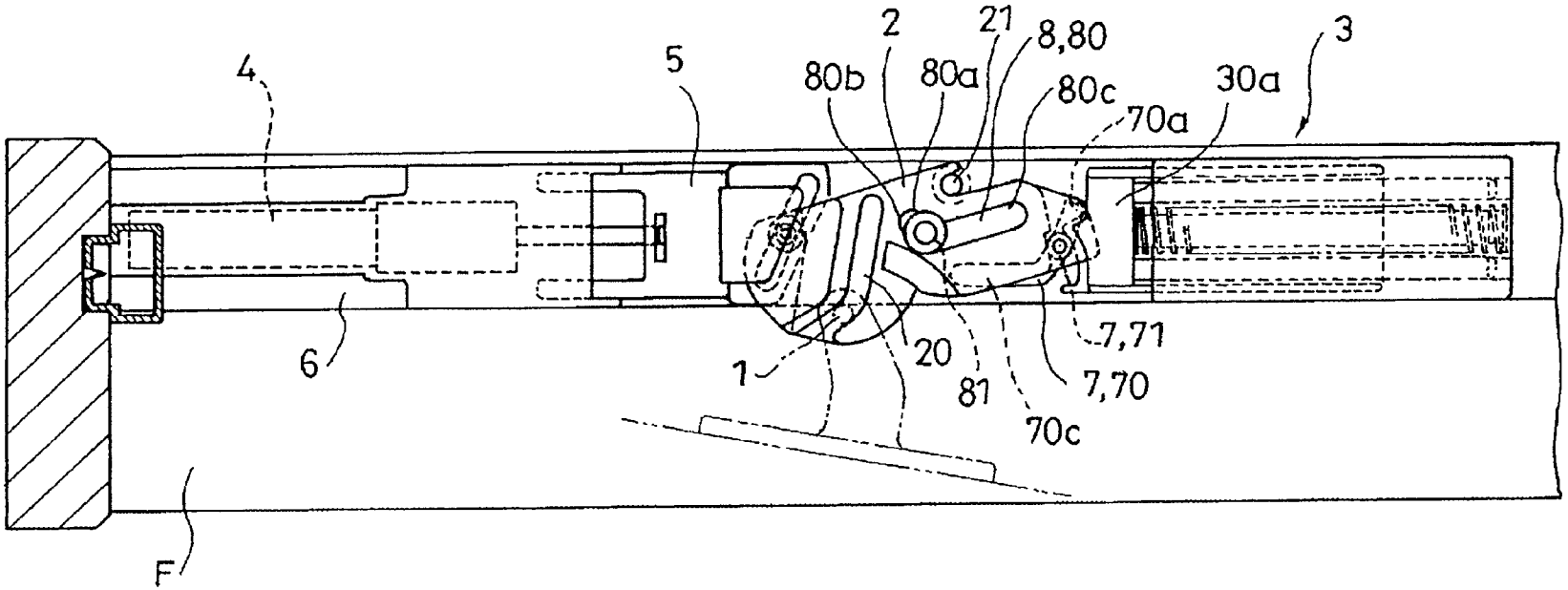
FIG. 6 is a structural diagram in bottom view of the same.
Figure 7:
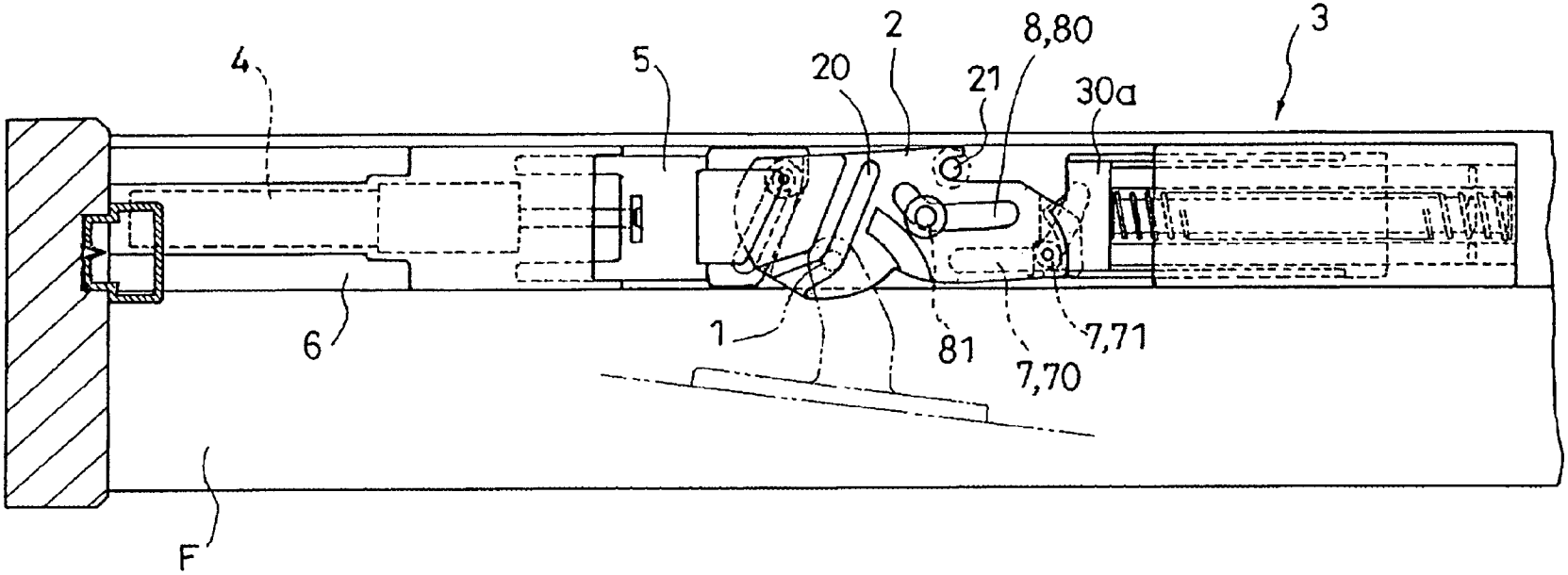
FIG. 7 is a structural diagram in bottom view of the same.

Specifically, in the illustrated example, the aforementioned contacted part 24 is a shaft-form sliding element 71 formed on the other end side 2*b* of the catcher 2. Also, when the catcher 2 is in the standby position, the aforementioned backward-slanted part 30*d* of the contacting part 30*b* is pushed against from in front of the sliding element 71 by the aforementioned urging. By this, the sliding element 71 (may be the contacted part 24) of the first cam means 7 to be described is pushed against a rear end 70*b* of a first part 70*a* of a cam groove 70 to be described, and a sliding element 81 of the second cam means 8 is pushed against a rear end 80*b* of a first part 80*a* of a cam groove 80 to be described, so that the state in which the catcher 2 is in the standby position is held. When the catcher 2 catches the striker 1 and the forward rotation of the catcher 2 is started from this state, the contacted part 24 of the catcher 2 is moved while causing the slider 30 of the urging means 3 to move slightly in the direction opposing the urging toward side of the tip part 30*c* of the contacting part 30*b* (FIG. 4). Also, when the contacted part 24 rides over the tip part 30*c* of the contacting part 30*b*, the slider 30 of the urging means 3 is moved toward the side of the catcher 2 by the aforementioned urging while pushing the forward-slanted part 30*e* of the contacting part 30*b* against the sliding element 71, whereby the forward rotation of the catcher 2 is assisted from mid-course. Also, after this, when the catcher 2 is rotated forward up to a position where the sliding element 71 of the first cam means 7 to be described enters into a second part 70*c* of the cam groove 70 and the sliding element 81 of the second cam means 8 to be described enters into a second part 80*c* of the cam groove 80, the second parts 70*c* and 80*c* of the cam grooves 70 and 80 of both cam means 7 and 8 are positioned in a direction roughly following the length direction of the base 6, and therefore the sliding movement of the catcher 2 is assisted by the movement by the aforementioned urging of the slider 30 of the urging means 3. In the illustrated example, a boss part 26*a* projecting downward on the side of the lower face of the catcher 2 is formed in a place for formation of a hole 26 to be described, and the forward movement of the catcher 2 can be assisted also by arranging so that this boss part 26*a* is brought in contact with the contacting part 30*b*.

The damping means 4 applies damping force to the aforementioned forward movement of the catcher 2. By this, in this mode of the embodiment, then the damping force can be applied further ahead from the prescribed position through the catcher 2 to the forward movement of the movable body M toward the reference position, so that the forward movement is performed gently.

Specifically, in this mode of the embodiment, such damping means 4 are made as a piston damper 40 using resistance to movement of a piston, not illustrated, inside a cylinder as damping force; and either one of a piston rod 40*b* or the cylinder 40*a* is fixed to the base 6, and the other of these is connected to the catcher 2 so that movement or relative movement of the piston is brought about by forward movement of the catcher 2.

Also, such piston damper 40 and the catcher 2 are connected by a connecting member 5 combined on the base 6 to be capable of sliding movement following the direction x of sliding movement of the catcher 2; and either one of a connecting cam groove 50 formed in a direction diagonally intersecting the direction x of sliding movement or a connecting sliding element 25 to be guided therein is formed on the catcher 2, and the other of these is formed on such connecting member 5.

In the illustrated example, the piston damper 40 is housed inside the housing part 63*b* for the damping means 4 of the base 6, with the projecting side of the piston rod 40*b* oriented toward the side of the catcher 2 through the open place of the housing part 63*b*, and the end part of the cylinder 40*a* opposite the projecting side of the piston rod 40*b* placed in contact with a closed part on the one end 6*a* of the base 6 opposite the open place of the housing part 63*b*. In addition, the connecting member 5, which is guided to the housing part 63*b* for such damping means 4 and is moved sliding in the length direction of the base 6, is assembled on the projecting end 40*c* of the piston rod 40*b*. Also, such connecting cam groove 50 is provided on the connecting member 5, and the connecting sliding element 25, which assumes a shaft form that is guided through the connecting cam groove 50, is provided further to the rear from the aforementioned receiving groove 20 on the one end side 2*a* of the catcher 2. Specifically, the end part of the connecting member 5 oriented toward the catcher 2 is positioned so as to sandwich the upper face of the one end side 2*a* of the catcher 2 and the lower face of the support part 63*a* of the base 6, and the aforementioned connecting cam groove 50 is formed so as to approach the center 21 of rotation of the catcher 2 while approaching a rear end of the groove from the side of a front end of the groove.

By this, in this mode of the embodiment, the connecting member 5 is concomitantly moved sliding when the catcher 2 is moved forward, so that the damping force of the aforementioned piston damper 40 is applied through the connecting member 5 in the entire process of the forward movement. Also, because the forward movement of the catcher 2 becomes the aforementioned sliding movement from midcourse, a greater amount of plunging of the piston rod 40*b* constituting the piston damper 40 into the cylinder 40*a* than in the case when the piston rod 40*b* is plunged using only rotation of the catcher 2 is easily ensured, and a sufficient damping force can be applied through the catcher 2 to the forward movement of the movable body M from the prescribed position. Symbol 64 in the drawings indicates a guide groove for the aforementioned connecting sliding element 25, provided on the support part 63*a* for the catcher 2 of the base lower part 63. It can also be arranged so that the aforementioned piston rod 40*b* or cylinder 40*a* is directly pressed by the one end side 2*a* of the catcher 2 during forward movement of the catcher 2.

Also, in this mode of the embodiment, first cam means 7 for cooperatively controlling the reciprocal movement of the catcher 2 are provided respectively on the catcher 2 and the base 6; and second cam means 8 for cooperatively controlling the reciprocal movement of the catcher 2 are provided respectively on the catcher 2 and the base 6 in different positions from the first cam means 7.

Both cam means 7 and 8 are constituted respectively with a cam groove 70 or 80 and a sliding element 71 or 81 to be guided therein; and the cam grooves 70 and 80 of both cam means 7 and 8 are respectively provided with a first part 70*a* or 80*a* following an arc of a virtual circle centered on the center 21 of rotation during rotation of the catcher 2, and a second part 70*c* or 80*c* continuing therefrom and extending in a straight line.

In the illustrated example, the cam groove 70 of the first cam means 7 is formed on the base 6, and the cam groove 80 of the second cam means 8 is formed on the catcher 2.

The sliding element 71 of the first cam means 7 is provided on the other end side 2*b* of the catcher 2, and is constituted as a shaft form with the axis following the vertical direction. Specifically, such sliding element 71 has rollers 71*b* fitted on two stages vertically on the outside of a shaft 71*a* passed through a hole 26 provided on the catcher 2, so that the upper stage side of these two stages of rollers 71*b* is received inside the cam groove 70. The cam groove 70 of the first cam means 7 is provided with a second part 70*c* continuing along the length direction of the base 6 on the front edge side of the support part 63*a* for the catcher 2, and a first part 70*a* continuing toward the rear from the end part of the second part 70*c* on the other end 6*b* side of the base 6, and following an arc of a virtual circle centered on the center 21 of rotation of the catcher 2. A rear end 70*b* of the first part 70*a* is positioned further forward from the center 21 of rotation of the catcher 2.

Meanwhile, the sliding element 81 of the second cam means 8 is provided on the support part 63*a* for the catcher 2 in a place further forward from the center 21 of rotation of the catcher 2, and is constituted as a shaft form with the axis following the vertical direction. The cam groove 80 of the second cam means 8 is provided with a second part 80*c* continuing along the length direction between the one end side 2*a* and the other end side 2*b* of the catcher 2, and a first part 80*a* continuing toward the rear from the end part of the second part 80*c* on the one end side 2*a* of the catcher 2, and following an arc of a virtual circle centered on the center 21 of rotation of the catcher 2. A rear end 80*b* of the first part 80*a* also is positioned further forward from the center 21 of rotation of the catcher 2.

Also, in this mode of the embodiment, a shaft body 9 is provided on either one of the catcher 2 or the base 6 in a position to serve as the aforementioned center 21 of rotation during rotation of the catcher 2, and a shaft bearing part 27 is provided on the other of these to axially support the shaft body 9 in a manner so as to release the axial support of the shaft body 9 during sliding movement of the catcher 2. In the illustrated example, such shaft body 9 is provided on the support part 63*a* for the catcher 2 on the base 6, and is constituted as a shaft form with the axis following the vertical direction. Also, the shaft bearing part 27 is provided on the catcher 2. In the illustrated example, a rear edge 28 of the catcher 2 is divided into a first edge 28*a* from the one end side 2*a* and up to a position about halfway in the length direction of the catcher 2, and a second edge 28*b* from the position about halfway in the length direction up to the other end side 2*b*. The second edge 28*b* is positioned further forward from the first edge 28*a*, and a step part 28*c* is formed between both edges 28*a* and 28*b* (FIG. 4). Also, the step part 28*c* is formed so as to have an outline in semicircular arc form copying a virtual shaft hole for receiving the aforementioned shaft body 9, so that such shaft body 9 is inserted and hooked from the other end 6*b* side of the base 6. That is, in this mode of the embodiment, such step part 28*c* functions as the aforementioned shaft bearing part 27.

Figure 3:
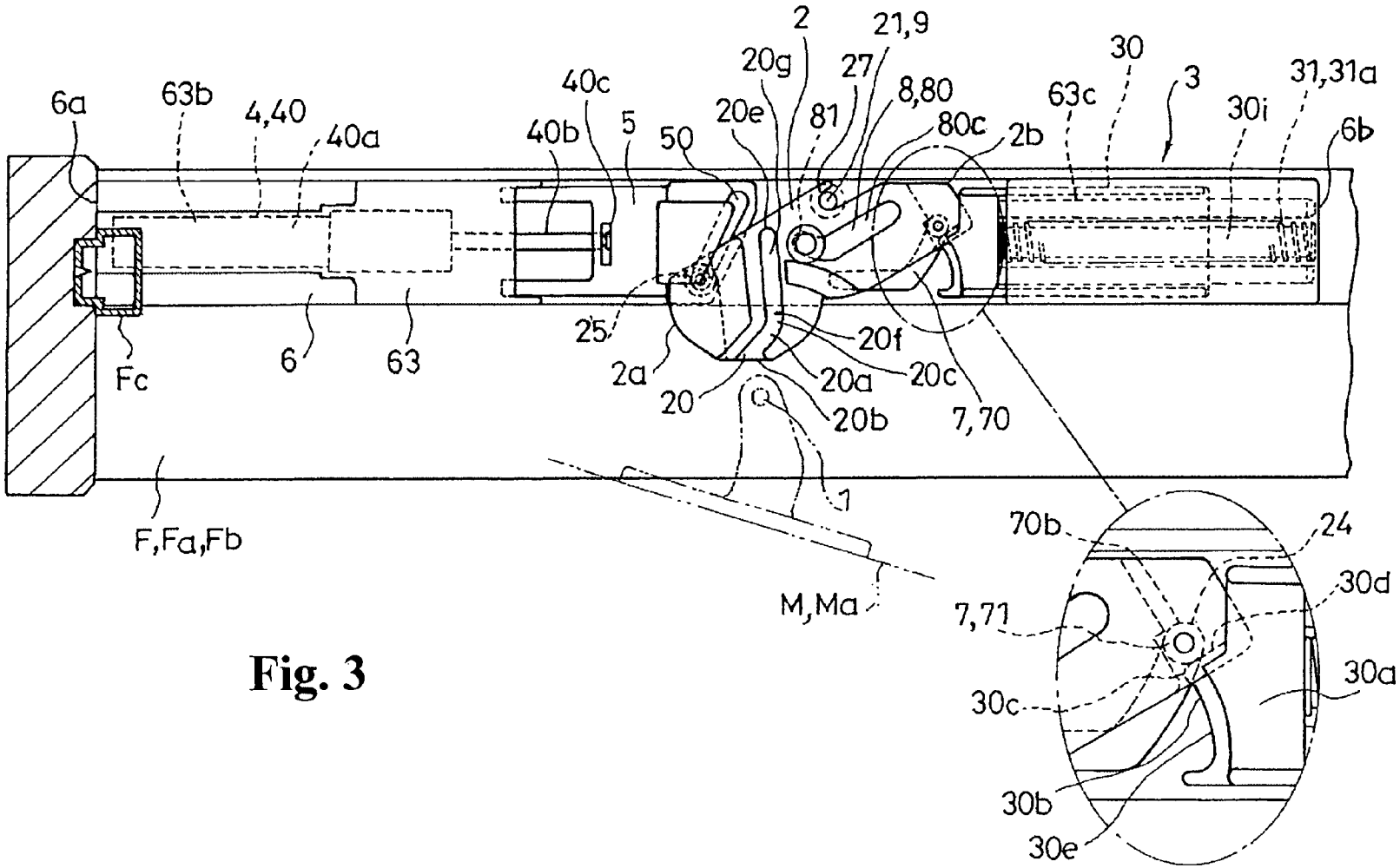
FIG. 3 is a structural diagram in bottom view of the same (catcher in standby position)

By this, in this mode of the embodiment, the state in which the catcher 2 is in the standby position can be held by the urging of the aforementioned urging means 3, with the sliding element 71 of the first cam means 7 positioned at the end part (rear end 70*b*) of the first part 70*a* opposite the side connecting through with the second part 70*c* of the cam groove 70 of the first cam means 7, and with the sliding element 81 of the second cam means 8 positioned at the end part (rear end 80*b*) of the first part 80*a* opposite the side connecting through with the second part 80*c* of the cam groove 80 of the second cam means 8 (FIG. 3). Also, the striker 1 can be caught in the prescribed position and the catcher 2 can be rotated forward from the standby position accompanying the forward operation of the movable body M. In this mode of the embodiment, the rotation can furthermore be accomplished with little unintentional movement by using the aforementioned shaft body 9. Also, after the sliding elements of both cam means 7 and 8 enter into the respective second parts, the catcher 2 can be moved sliding up to the final position by the urging of the aforementioned urging means 3. The shaft bearing part 27 of the aforementioned shaft body 9 does not impede this sliding movement. In the illustrated example, during this sliding movement, the catcher 2 is moved toward the one end 6*a* side of the base 6, that is, the side toward the hinge Fd of the door Ma as the movable body M, so that the shaft body 9 slips out relatively from the shaft bearing part 27 toward the other end 6*b* side of the base 6 (FIG. 8). The withdrawing part 20*e* of the aforementioned receiving groove 20 is formed in a slanted form so as to approach the other end 6*b* of the base 6 while going toward the rear end 20*g*. Meanwhile, when the striker 1 enters in further forward from the hinge Fd serving as the center of rotation of the door Ma, a track of movement approaching the side of the door frame Fa provided on the hinge Fd is drawn, and therefore the door Ma is moved forward smoothly to the reference position by such sliding movement of the catcher 2. When the door Ma as the movable body M thus moved forward and positioned in the reference position is operated to open, the catcher 2 moves sliding in the opposite direction to that during forward movement, so that the shaft body 9 is again inserted into the shaft bearing part 27 when the sliding elements of the aforementioned both cams 7 and 8 are positioned inserted into the first parts.

The state in which the catcher 2 is in the standby position can be held also by either one cam means 7 (or 8) of such first cam means 7 or second cam means 8 and the aforementioned shaft body 9, by the urging of the aforementioned urging means 3, with the sliding element 71 or 81 of the cam means 7 or 8 positioned at the end part 70*b* or 80*b* of the first part 70*a* or 80*a* opposite the side connecting through with the second part 70*c* or 80*c* of the cam groove 70 or 80 of either cam means 7 or 8, and with the shaft body 9 pushed against the shaft bearing part 27. Also, in this case as well, the striker 1 can be caught in the prescribed position and the catcher 2 can be rotated forward from the standby position accompanying the forward operation of the movable body M. Also, after the sliding element of either cam means 7 (or 8) enters into the second part 70*c* or 80*c* of the cam groove 70 or 80, the catcher 2 can be moved sliding up to the final position by the urging of the aforementioned urging means 3.

The entire contents of the specification, claims, drawings, and abstract of Japanese Patent Application No. 2008-270331, filed on Oct. 20, 2008, are incorporated by reference herein as a disclosure of the specification of the present invention.

What is claimed is:

1. An assisting mechanism for a movable body comprising:

a striker provided on one of a main body and the movable body combined on the main body to be capable of reciprocal movement between a reference position and a deployment position;

a catcher provided on the other of the main body and the movable body for catching the striker in a prescribed position when the movable body is operated to move forward toward the reference position, and for assisting the forward movement of the movable body to the reference position, the catcher being supported on a base thereof;

a damping device for applying a damping force to a forward movement of the catcher, an urging device provided on the base; and a connecting member provided on the base, between the catcher and the damping device, wherein the catcher is supported on the base to be capable of reciprocal movement between a standby position where the striker can be caught or released and a final position, and sliding movement toward the final position after rotating at a fixed angle from the standby position during the forward movement from the standby position;

at least holding the catcher in the standby position and said sliding movement are made by urging of the urging device;

said holding is released and forward rotation of the catcher is started when the striker is caught by the catcher in the standby position by the forward movement of the movable body, and the forward movement is assisted by said urging from a mid-course of the forward movement, cam devices for cooperatively controlling a rotational movement and a sliding movement of the catcher are provided respectively between the catcher and the base;

a shaft body is provided on either one of the catcher and the base in a position to serve as a center of rotation during rotational movement of the catcher; and a shaft bearing part is provided on the other of the catcher and the base to axially support the shaft body in a manner so as to release an axial support of the shaft body during the sliding movement of the catcher.

2. The assisting mechanism for the movable body according to claim 1, wherein the base has a width and a length, and the sliding movement of the catcher is performed along a length direction.

3. The assisting mechanism for the movable body according to claim 1, wherein catching of the striker is accomplished by a receiving groove for the striker formed on the catcher;

the receiving groove has an introducing part and a withdrawing part, the catcher is rotated by the striker on entering the introducing part in the standby position, and the striker is guided to the withdrawing part by the rotation; and the withdrawing part is formed so as to intersect with a direction of the sliding movement of the catcher.

4. The assisting mechanism for the movable body according to claim 1, wherein the urging device is provided with a contacting part corresponding to a contacted part of the catcher, and either one of the contacted part and the contacting part or both is constituted as a protruding form, so that the contacted part rides over the contacting part while pushing the side of the contacting part inward in a direction opposing the urging in the process of the forward movement of the catcher in the standby position.

5. The assisting mechanism for the movable body according to claim 1, wherein the base has a width and a length, the damping device is arranged between the catcher and one end of the base, and the urging device is arranged between the catcher and the other end of the base.

6. The assisting mechanism for the movable body according to claim 1, wherein the cam devices for cooperatively controlling the movements of the catcher are provided respectively on the catcher and the base in different positions;

both cam devices include a cam groove and a sliding element to be guided therein;

the cam grooves of both cam devices respectively have a first part along an arc of a virtual circle centered on a center of rotation during rotation of the catcher, and a second part continuing therefrom and extending in a straight line.

7. The assisting mechanism for the movable body according to claim 1, wherein the catcher has a receiving groove, the receiving groove has an introducing part and a withdrawing part, the introducing part extends diagonally to the withdrawing part toward the urging device, the withdrawing part intersects with a direction of the sliding movement of the catcher, when the striker contacts with the introducing part, the catcher starts rotating, and when the striker moves into the withdrawing part, the catcher slides by the urging of the urging device.

8. The assisting mechanism for the movable body according to claim 7, wherein the striker has a striker-urging member and is configured to withdraw in opposition to an urging force of the striker-urging member, the catcher has an auxiliary groove, and when the catcher accidentally moves forward to the final position without having the striker in the receiving groove, the striker is configured to move in the auxiliary groove and to be placed in the withdrawing part by riding over between a rear end of the auxiliary groove and the withdrawing part.

9. An assisting mechanism for a movable body, comprising:

a striker provided on one of a main body and the movable body combined on the main body to be capable of reciprocal movement between a reference position and a deployment position;

a catcher provided on the other of the main body and the movable body for catching the striker in a prescribed position when the movable body is operated to move forward toward the reference position, and for assisting the forward movement of the movable body to the reference position, the catcher being supported on a base thereof;

a damping device for applying a damping force to a forward movement of the catcher, an urging device provided on the base; and a connecting member provided on the base, between the catcher and the damping device, wherein the catcher is supported on the base to be capable of reciprocal movement between a standby position where the striker can be caught or released and a final position, and sliding movement toward the final position after rotating at a fixed angle from the standby position during the forward movement from the standby position;

at least holding the catcher in the standby position and said sliding movement are made by urging of the urging device;

said holding is released and forward rotation of the catcher is started when the striker is caught by the catcher in the standby position by the forward movement of the movable body, and the forward movement is assisted by said urging from a mid-course of the forward movement, first cam devices for cooperatively controlling the reciprocal movement of the catcher are provided respectively on the catcher and the base;

second cam devices for cooperatively controlling the reciprocal movement of the catcher are provided respectively on the catcher and the base in different positions from the first cam devices, and both cam devices include a cam groove and a sliding element to be guided therein; and the cam grooves of both cam devices respectively have a first part along an arc of a virtual circle centered on a center of rotation during rotation of the catcher, and a second part continuing therefrom and extending in a straight line.

10. The assisting mechanism for the movable body according to claim 9, wherein the catcher has a receiving groove, the receiving groove has an introducing part and a withdrawing part, the introducing part extends diagonally to the withdrawing part toward the urging device, the withdrawing part intersects with a direction of the sliding movement of the catcher, when the striker contacts with the introducing part, the catcher starts rotating, and when the striker moves into the withdrawing part, the catcher slides by the urging of the urging device.

11. The assisting mechanism for the movable body according to claim 10, wherein the striker has a striker-urging member and is configured to withdraw in opposition to an urging force of the striker-urging member, the catcher has an auxiliary groove, and when the catcher accidentally moves forward to the final position without having the striker in the receiving groove, the striker is configured to move in the auxiliary groove and to be placed in the withdrawing part by riding over between a rear end of the auxiliary groove and the withdrawing part.

12. An assisting mechanism for the movable body, comprising:

a striker provided on one of a main body and the movable body combined on the main body to be capable of reciprocal movement between a reference position and a deployment position;

a catcher provided on the other of the main body and the movable body for catching the striker in a prescribed position when the movable body is operated to move forward toward the reference position, and for assisting the forward movement of the movable body to the reference position, the catcher being supported on a base thereof;

a damping device for applying a damping force to a forward movement of the catcher, an urging device provided on the base; and a connecting member provided on the base, between the catcher and the damping device, wherein the catcher is supported on the base to be capable of reciprocal movement between a standby position where the striker can be caught or released and a final position, and sliding movement toward the final position after rotating at a fixed angle from the standby position during the forward movement from the standby position;

at least holding the catcher in the standby position and said sliding movement are made by urging of the urging device;

said holding is released and forward rotation of the catcher is started when the striker is caught by the catcher in the standby position by the forward movement of the movable body, and the forward movement is assisted by said urging from a mid-course of the forward movement, the damping device is made as a piston damper using resistance to movement of a piston inside a cylinder as damping force;

either one of a piston rod and the cylinder is fixed to the base, and the other of the piston rod and the cylinder is connected to the catcher so that movement or relative movement of the piston is brought about by the forward movement of the catcher;

the piston damper and the catcher are connected by the connecting member combined on the base to be capable of sliding movement along a direction of the sliding movement of the catcher; and either one of a connecting cam groove formed in a direction diagonally intersecting the direction of the sliding movement and a connecting sliding element to be guided therein is formed on the catcher, and the other of the connecting cam groove and the catcher is formed on the connecting member.

13. The assisting mechanism for the movable body according to claim 12, wherein the catcher has a receiving groove, the receiving groove has an introducing part and a withdrawing part, the introducing part extends diagonally to the withdrawing part toward the urging device, the withdrawing part intersects with a direction of the sliding movement of the catcher, when the striker contacts with the introducing part, the catcher starts rotating, and when the striker moves into the withdrawing part, the catcher slides by the urging of the urging device.

14. The assisting mechanism for the movable body according to claim 13, wherein the striker has a striker-urging member and is configured to withdraw in opposition to an urging force of the striker-urging member, the catcher has an auxiliary groove, and when the catcher accidentally moves forward to the final position without having the striker in the receiving groove, the striker is configured to move in the auxiliary groove and to be placed in the withdrawing part by riding over between a rear end of the auxiliary groove and the withdrawing part.

* * * * *